US005577686A

United States Patent [19]

Moody

[11] Patent Number: 5,577,686

[45] Date of Patent: Nov. 26, 1996

[54] SPINDLE ADAPTER APPARATUS FOR PAPER ROLL PRODUCT

[75] Inventor: John R. Moody, Antioch, Calif.

[73] Assignee: James River Paper Company, Inc., Richmond, Va.

[21] Appl. No.: 626,602

[22] Filed: Apr. 2, 1996

Related U.S. Application Data

[63] Continuation of Ser. No. 291,404, Aug. 16, 1994, abandoned.

[51] Int. Cl.[6] ..... B65H 16/06; B65H 18/04

[52] U.S. Cl. ..... 242/597.4; 242/597.5

[58] Field of Search ..... 242/597.4, 597.5, 242/597, 597.1, 336, 597.3, 597.6

[56] References Cited

U.S. PATENT DOCUMENTS

| | | | |
|---|---|---|---|
| 3,079,099 | 2/1963 | Blain | 242/597.5 |
| 3,375,995 | 4/1968 | Roman | 242/597.6 |
| 3,417,939 | 12/1968 | Bunting | 242/597.5 X |
| 3,612,423 | 10/1971 | Bahnser | 242/560.2 |
| 4,218,027 | 8/1980 | Pool | 242/597.4 |
| 4,807,823 | 2/1989 | Wyant | 242/560 |
| 5,009,313 | 4/1991 | Morand | 206/391 |
| 5,135,179 | 8/1992 | Morano | 242/423.1 |

FOREIGN PATENT DOCUMENTS

| | | | |
|---|---|---|---|
| 413408 | 2/1991 | European Pat. Off. | 242/597.5 |

*Primary Examiner*—John Q. Nguyen
*Attorney, Agent, or Firm*—Thomas R. Lampe

[57] ABSTRACT

Apparatus for mounting a paper roll product having a core on a coreless paper roll spindle having an enlargement. The apparatus includes an adapter spindle for sliding over the coreless paper roll spindle and a lock within the interior of the adapter spindle for locking the coreless paper roll spindle and the adapter spindle against substantial relative axial movement.

3 Claims, 2 Drawing Sheets

SPINDLE ADAPTER APPARATUS FOR PAPER ROLL PRODUCT

This is a continuation of application Ser. No. 08/291,404, filed Aug. 16, 1994, abandoned.

TECHNICAL FIELD

This invention relates to apparatus for mounting a paper roll product comprising a paper web wrapped about a central core on a coreless paper roll spindle having a spindle body and an enlargement located at the end of the spindle body.

BACKGROUND ART

U.S. patent application Ser. No. 08/159,535, filed Dec. 1, 1993, U.S. Pat. No. 5,370,339 discloses apparatus for dispensing web material from a coreless roll of such material. In particular, the invention disclosed therein incorporates structure which deters against theft of a coreless roll, i.e. a coreless paper roll having a plurality of convolutions and a central opening defined by the innermost convolution, until the roll has been substantially depleted.

Most conventional rolls of consumer paper products, such as toilet tissue, are not coreless in nature, instead comprising a paper web wrapped about a central core of paper-board or the like. The coreless paper roll dispenser apparatus disclosed in the above-identified application is not suitable for use with the more conventional paper roll product utilizing a core. The paper roll product with a core will not be mounted in a stable fashion on the apparatus. Furthermore, the roll with core can be readily removed from the apparatus and the paper roll product stolen. Obviously, this becomes a particular problem when the apparatus and roll are employed in public washroom facilities.

A search directed to the invention of the present application located the following United States patents, which are believed to be representative of the current state of the prior art in this field: U.S. Pat. No. 5,135,179, issued Aug. 4, 1992, U.S. Pat. No. 5,009,213, issued Apr. 23, 1991, U.S. Pat. No. 3,612,423, issued Oct. 12, 1971, U.S. Pat. No. 4,218,027, issued Aug. 19, 1980, and U.S. Pat. No. 4,807,823, issued Feb. 28, 1989.

The above-identified patents do not address the problems discussed above and which are solved by the present invention.

DISCLOSURE OF INVENTION

The apparatus of the present invention is for mounting a paper roll product comprising a paper web wrapped about a central core on a coreless paper roll spindle having a spindle body and an enlargement on the spindle body.

The apparatus includes an adapter spindle defining an interior for receiving a coreless paper roll spindle, the adapter spindle having an inner surface for engaging the coreless paper roll spindle and an outer surface for engaging and supporting the core of a paper roll product.

The apparatus additionally includes lock means within the adapter spindle interior for lockingly engaging the enlargement of the coreless paper roll spindle after the coreless paper roll spindle has been received within the adapter spindle interior to lock together the coreless paper roll spindle and the adapter spindle against substantial relative axial movement.

The enlargement has a shoulder and the lock means includes at least one detent for engaging the shoulder.

Release means is cooperable with the lock means for selectively disengaging the lock means from the enlargement whereby the adapter spindle can be selectively manually removed from the coreless paper roll spindle in an axial direction.

Other features, advantages, and objects of the present invention will become apparent with reference to the following description and accompanying drawings.

BEST MODE FOR CARRYING OUT THE INVENTION

Figure 1:
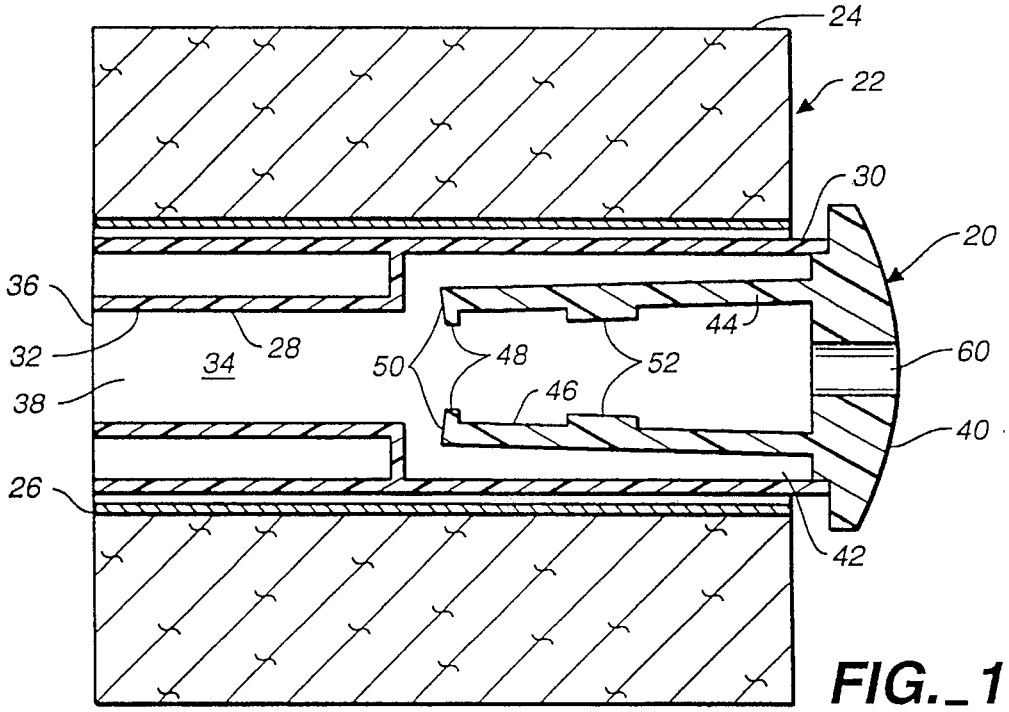
FIG. 1 is an elevational view in cross-section illustrating apparatus constructed in accordance with the teachings of the present invention having a paper roll product with core disposed thereabout and prior to installation onto a coreless paper roll spindle.

Referring now to the drawings, reference numeral 10 designates a coreless paper roll spindle or mounting apparatus of the type disclosed in co-pending U.S. patent application Ser. No. 08/159,535, filed Dec. 1, 1993. In the interest of simplicity, spindle 10 will not be described in detail. Suffice it to say that coreless paper roll spindle 10 has a spindle body 12 and an enlargement 14 located at an end of the spindle body 12. Enlargement 14 has a shoulder 16.

The apparatus of the present invention is designated by reference numeral 20 and such apparatus is for the purpose of rotatably mounting a paper roll product on the coreless paper roll spindle 10. The disclosed paper roll product is a conventional roll of toilet tissue 22 comprising a tissue web 24 wrapped about a central core 26 of paperboard or the like.

It is to be noted that the central aperture or passageway defined by the core 26 is significantly larger than the outer peripheral surface of coreless paper roll spindle 10. Therefore, the coreless paper roll spindle would be completely inappropriate for rotatably mounting the conventional roll with a core and certainly would not cooperate therewith in any way that would prevent unauthorized removal or theft of the roll. The apparatus 20 remedies such deficiencies.

Apparatus 20 may be formed of any suitable material such as plastic and includes an adapter spindle 28. The adapter spindle has a cylindrical-shaped outer surface 30 for engaging and supporting the core 26 of roll 22. For purposes of illustration, a gap is shown in the drawings between the core and the adapter spindle outer surface. It will be appreciated, however, that gravity will continuously urge the core 26 against the uppermost segment of the outer surface 30.

Adapter spindle 28 also has an inner surface 32 for engaging the coreless paper roll spindle in a manner which will be described below. The adapter spindle has an interior 34, an open end 36 communicating with the interior, and an opposed end closed or covered by cap 40. The interior includes a reduced interior portion 38 defined by double wall construction at the open end of the adapter spindle.

Figure 2:
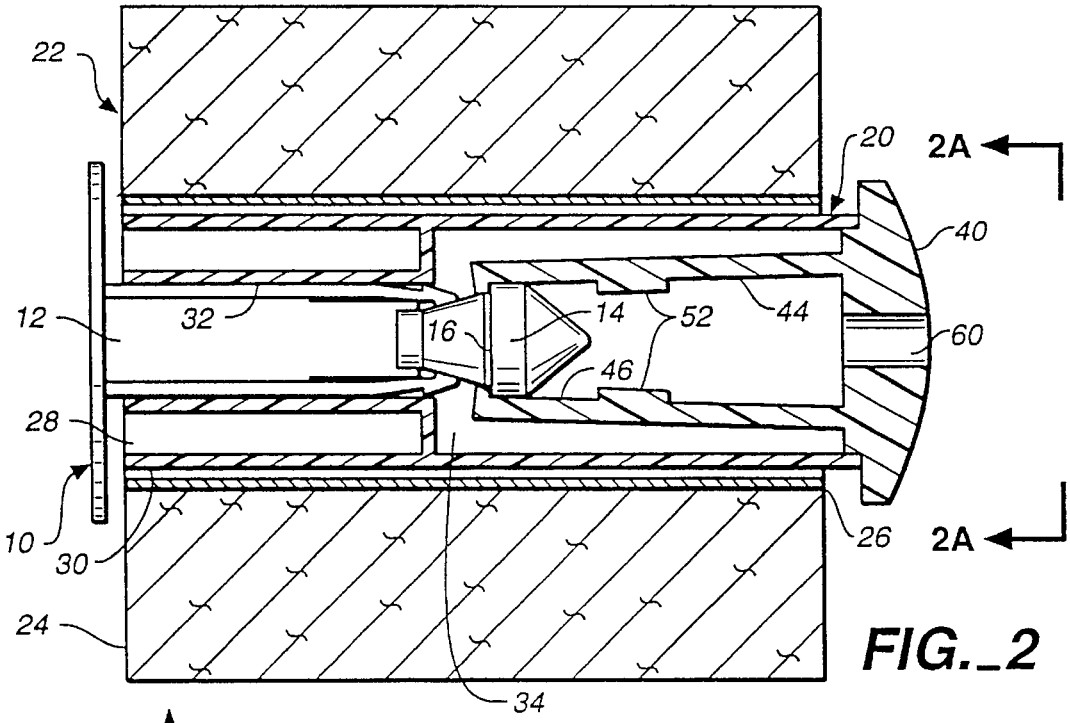
FIG. 2 is a view similar to FIG. 1, but illustrating the apparatus and roll product installed on and locked into position relative to a coreless paper roll spindle having a spindle body and an enlargement located at an end of the spindle body.

Cap 40 projects outwardly from outer surface 30 and blocks sliding movement of the roll 22 to the right as viewed in FIGS. 1 and 2 because the paper web and core portions of a roll will abut against the cap when moving in that direction. Cap 40 is fixedly secured to the rest of the adapter spindle by any known expedient.

Projecting from cap 40 into an enlarged portion 42 of interior 34 are elongated flexible members 44, 46. Members 44, 46 have detents or projections 48 at the distal ends thereof. The detents 48 have beveled surfaces 50. Between the detents 48 and the cap 40 the walls of the flexible members 44, 46 are thickened to provide inwardly projecting cam surfaces 52.

The first step in the utilization of apparatus 20 is to slide roll of toilet tissue 22 over the adapter spindle as shown in FIG. 1.

Next, the adapter spindle is axially aligned with the coreless paper roll spindle and the apparatus 20 is pushed over the coreless paper roll spindle so that the coreless paper roll spindle enters interior 34 and the distal ends of elongated flexible members 44, 46 engage the enlargement 14.

The operator continues to push the apparatus 20 while elongated flexible members 44, 46 flex and until the detents 48 ride over the enlargement and snap into position behind and in engagement with shoulder 16 of the enlargement, as shown in FIG. 2. It will be appreciated that the beveled surfaces 50 of the detents will facilitate movement of the elongated flexible member distal ends over the enlargement. It will be noted that the elongated flexible members 44 normally converge toward one another when unflexed (see FIG. 1) so that they are continuously biased toward the coreless paper roll spindle.

When the coreless paper roll spindle and the adapter spindle are locked into position as shown in FIG. 2 they are locked against substantial relative axial movement and an individual will have an extremely difficult time trying to pull the apparatus 20 and roll 22 from coreless paper roll spindle 10.

Cap 40 has a key hole 60 therein which communicates with the interior 34. The shape of key hole 60 corresponds to the shape of end 62 of key 64. Key end 62 has cam surfaces 66 on the opposed lateral arms of the key end.

Figure 3A:
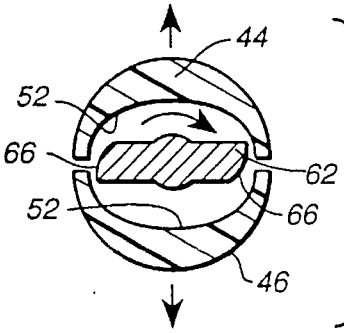
FIG. 3A is a schematic cross-sectional view illustrating selected portions of elongated flexible member of the apparatus the key and prior to release of the adapter spindle from the coreless paper roll spindle taken along line 3A—3A in FIG. 3.
Figure 4A:
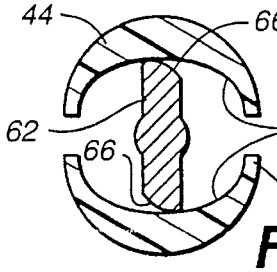
FIG. 4A is a view similar to FIG. 3A, but illustrating the condition of the key and elongated flexible members when the adapter spindle can be released from the coreless paper roll spindle, as taken along line 4A—4A in FIG. 4.
Figure 3:
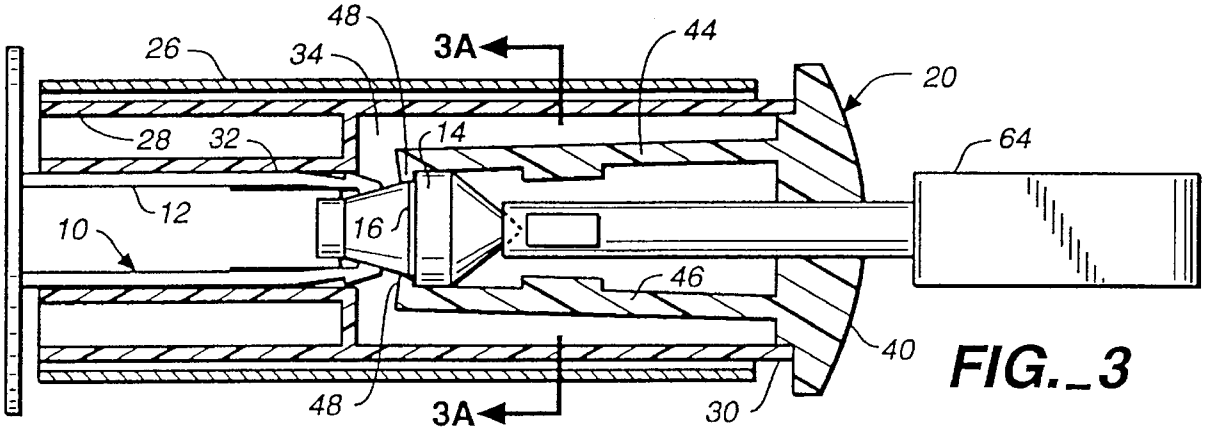
FIG. 3 is a cross-sectional elevational view illustrating a key being utilized to release the apparatus from the coreless paper roll spindle after depletion of the paper roll product.
Figure 2A:
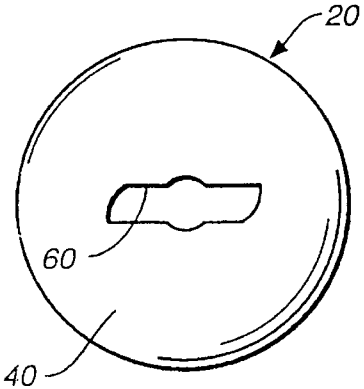
FIG. 2A is an end view taken in the direction of arrows 2A—2A in FIG. 2 and illustrating an end cap of the adapter spindle apparatus.
Figure 4:
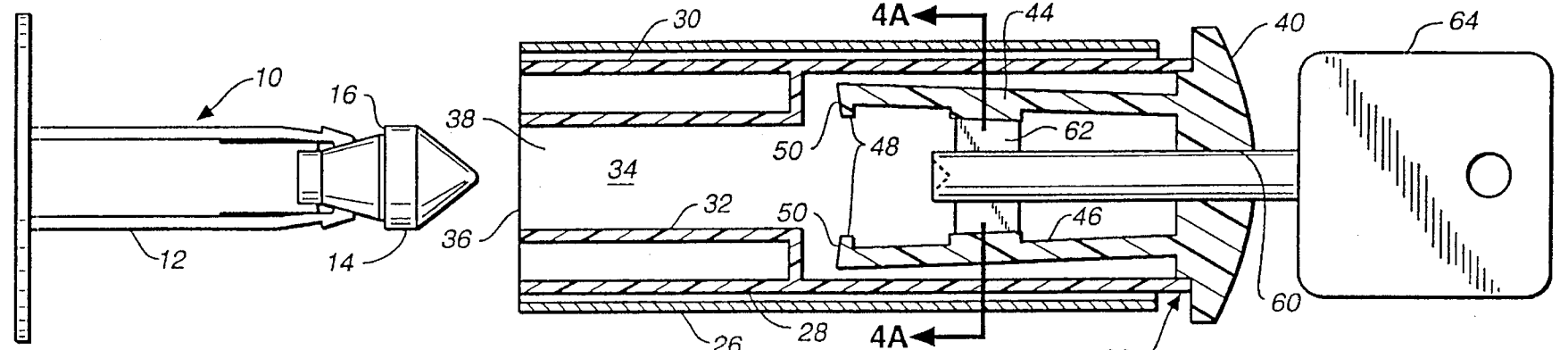
FIG. 4 is an exploded view illustrating the apparatus of the present invention in cross-section and after removal thereof from the coreless paper roll spindle.

To remove the adapter spindle from the coreless paper roll spindle 10, key end 62 is inserted through key hole 60 into interior 34 until the key end is in alignment with the cam surfaces 52 of elongated flexible members 44, 46. Proper positioning of the key exists when a recess in key end 62 receives the end of enlargement 14 and the key and enlargement are engaged. The key end 62 will, upon entry, be disposed as shown in FIG. 3A. Rotation of the key end 62 to the position shown in FIG. 4A will cause the cam surfaces of the key end to engage the cam surfaces of the elongated flexible members and force the elongated flexible members apart as shown in FIG. 4A. This will result in the detents 48 at the end of the elongated flexible members being withdrawn from behind shoulder 16. Thus, the operator can readily separate the adapter spindle from the coreless paper roll spindle by pulling the adapter spindle. FIG. 4 shows the adapter spindle completely removed from the coreless paper roll spindle.

I claim:

1. Apparatus for releasably mounting a paper roll product comprising a paper web wrapped about a central core having an inner diameter on a coreless paper roll spindle having an elongated spindle body and an enlargement having a shoulder on the spindle body, said enlargement having an outer diameter less than the inner diameter of said central core, and said apparatus comprising, in combination:

an adapter spindle defining an interior for receiving the coreless paper roll spindle, said adapter spindle having an inner surface engaging the coreless paper roll spindle and an outer surface engaging and supporting the core of a paper roll product when the adapter spindle interior receives the coreless paper roll spindle;

lock means within the adapter spindle interior including at least two elongated flexible members connected to said adapter spindle and each said elongated flexible member having a detent thereon substantially simultaneously lockingly engaging the shoulder of said enlargement when the coreless paper roll spindle is received within said adapter spindle interior for locking together against substantial relative axial movement said coreless paper roll spindle and said adapter spindle; and release means cooperable with the flexible members within the interior of said adapter spindle to disengage the detents thereof from the shoulder of said enlargement and unlock said adapter spindle from said coreless paper roll spindle, said adapter spindle having an axially open end communicating with said adapter spindle interior and an axially opposite substantially closed end, said elongated flexible members extending from and in a direction away from said closed end and said detents being attached to said elongated flexible members at locations spaced from said closed end, each said elongated flexible member including a radially inner cam surface, said release means comprising a key, said key having a cross-sectional dimension greater than the distance between said cam surfaces when said detents are lockingly engaging said shoulder and being insertable within the interior of said adapter spindle and substantially simultaneously engageable with said cam surfaces of said elongated flexible members to move the detents of said elongated flexible members away from each other and away from said shoulder upon rotation of said key and to disengage said detents from said shoulder, said adapter spindle including an end cap defining a key hole positioned in between said flexible members and communicating with said adapter spindle interior for receiving said key, and said adapter spindle interior including adjoining first and second adapter spindle interior portions, an inner surface at said first adapter spindle interior portion being axially spaced from said flexible members and surrounding and engaging said spindle body adjacent to said enlargement and said second adapter spindle interior portion having a cross-sectional size greater than the cross-sectional size of said first adapter spindle interior portion and surrounding and radially spaced from said elongated flexible members whereby outward movement of said detents will not be impeded by said second adapter spindle interior portion.

2. The apparatus according to claim 1 wherein said detents have bevelled surfaces engaging said enlargement when said adapter spindle receives said coreless paper roll spindle.

3. The apparatus according to claim 1 wherein a portion of said end cap has a greater diameter than said adapter spindle so as to be in axial registry with the core of a paper roll product on said adapter spindle and engageable by the core to limit axial movement of said paper roll product relative to said adapter spindle.

* * * * *